US010226090B2

(12) United States Patent
Allouche

(10) Patent No.: US 10,226,090 B2
(45) Date of Patent: Mar. 12, 2019

(54) CONTAINER OPENING DEVICE AND GARMENT

(71) Applicant: Abraham I. Allouche, Hallandale, FL (US)

(72) Inventor: Abraham I. Allouche, Hallandale, FL (US)

( * ) Notice: Subject to any disclaimer, the term of this patent is extended or adjusted under 35 U.S.C. 154(b) by 44 days.

(21) Appl. No.: 15/073,069

(22) Filed: Mar. 17, 2016

(65) Prior Publication Data

US 2017/0265543 A1 Sep. 21, 2017

(51) Int. Cl.
*A41D 27/20* (2006.01)
*B67B 7/16* (2006.01)
*A41D 1/06* (2006.01)

(52) U.S. Cl.
CPC ..... *A41D 27/201* (2013.01); *A41D 1/06* (2013.01); *B67B 7/16* (2013.01)

(58) Field of Classification Search
CPC .... B67B 7/00; B67B 7/16; A41D 1/06; A41D 27/201
USPC ..... 81/3, 55, 3.25, 3.09
See application file for complete search history.

(56) References Cited

U.S. PATENT DOCUMENTS 1,806,797 A 5/1931 Guiterman
3,175,233 A * 3/1965 Caravella ..... A44B 11/005 2/322
3,903,547 A * 9/1975 Schiller ..... A41F 9/002 2/321
5,133,233 A * 7/1992 Erwin ..... B67B 7/16 2/160
5,261,299 A * 11/1993 Kondos ..... A41D 19/01594 2/160
D420,265 S 2/2000 Pierce
D506,910 S 7/2005 Tham-itthisak
D548,931 S 8/2007 Valcourt
D550,931 S 9/2007 Valcourt
7,284,284 B2 * 10/2007 Wysopal ..... A42B 1/24 2/195.1
D582,127 S 12/2008 Johanns et al.
7,469,428 B2 * 12/2008 Brauner ..... A42B 1/24 2/171
D584,885 S 1/2009 Contreras
D585,632 S 2/2009 Contreras
7,484,249 B1 * 2/2009 Reese ..... A41D 13/04 2/48
8,196,221 B2 * 6/2012 Fuwausa ..... B67B 7/16 2/209.13

(Continued)

*Primary Examiner* — Shaun R Hurley
*Assistant Examiner* — Bao-Thieu L Nguyen
(74) *Attorney, Agent, or Firm* — Malloy & Malloy, PL

(57) ABSTRACT

A garment structured to facilitate opening of a container, through the provision of an opening member mounted thereon. A garment includes a closure flap movable between a covering and a non-covering position, wherein the opening device includes a base and an opening member connected to said closure flap and movable therewith into an out of an exposed, operative orientation corresponding to the closure flap being disposed into and out of the covering relation to the pocket. When in the operative orientation, the opening member includes an apertured construction disposed and structured to engage and exert a removing force on a closure of the container, wherein the closure may be in the form of a cap on bottle or other container.

27 Claims, 4 Drawing Sheets

(56) References Cited

U.S. PATENT DOCUMENTS

| | | | | |
|---|---|---|---|---|
| 8,549,667 | B1 * | 10/2013 | Fuller | A41D 27/20 2/160 |
| D706,090 | S | 6/2014 | Spector | |
| D747,077 | S | 1/2016 | Jayalath et al. | |
| D760,048 | S | 6/2016 | Jordan et al. | |
| D780,546 | S | 3/2017 | Kieu | |
| D786,538 | S | 5/2017 | Morenstein et al. | |
| D790,277 | S | 6/2017 | Mackesy, II et al. | |
| D792,179 | S | 7/2017 | Hsieh | |
| 2003/0070206 | A1 | 4/2003 | Palumbo | |
| 2006/0031977 | A1 * | 2/2006 | Wysopal | A42B 1/24 2/209.13 |
| 2007/0083984 | A1 | 4/2007 | Wagenknecht et al. | |
| 2007/0271679 | A1 * | 11/2007 | Wysopal | A42B 1/24 2/209.13 |
| 2008/0263741 | A1 * | 10/2008 | Tempini | A41D 27/201 2/69 |
| 2011/0030124 | A1 * | 2/2011 | Zhen | A42B 1/24 2/209.13 |
| 2011/0179545 | A1 * | 7/2011 | Rummel | A41D 27/08 2/69 |
| 2011/0253569 | A1 | 10/2011 | Lord | |
| 2011/0314593 | A1 | 12/2011 | Anderson | |
| 2013/0047317 | A1 * | 2/2013 | Hanover | A42B 1/24 2/209.12 |
| 2014/0216209 | A1 | 8/2014 | Shrock | |
| 2016/0318744 | A1 | 11/2016 | Koroly | |
| 2017/0265543 | A1 | 9/2017 | Allouche | |
| 2017/0265544 | A1 | 9/2017 | Allouche | |

* cited by examiner

CONTAINER OPENING DEVICE AND GARMENT

BACKGROUND OF THE INVENTION

Field of the Invention

The present invention is directed to a container opening device mounted on and operable in combination with a garment, wherein an opening member is secured to a base which in turn is mounted on and movable with a flap structure, which may or may not be in the form of a closure flap for a pocket of the garment. The opening member and base are movable with the closure flap into and out of an exposed, operative orientation concurrently to the closure flap being disposed into and out of a closing position relative to the pocket.

Description of the Related Art

Numerous individuals seek to bring capped containers, such as containers of juice, soda, or beer, to a wide-ranging possibility of events, for example to a concert or to the beach. As a result, such individuals frequently require some type of device in order to facilitate opening their capped containers. Known opening devices which are readily available on the commercial market include bottle openers and combination devices such as a bottle opener, can opener, and/or a corkscrew device. However, when an opening device is required to open a capped container, time and patience are needed to search and locate such a device. Additionally, an opening device is not convenient for individuals to transport with them due to its shape and size. Further, in many environments such as the beach, a picnic, etc. an opening device is frequently needed but frequently lost. Due to this inconvenience, most individuals do not transport an opening device with them.

Accordingly, there is a need for an opening device that is always ready and available, easily portable, and will not be lost while at an event. There appears to be an absence of a combined structure having multi-purpose uses such that an opening device may be utilized in combination with an item of everyday use, such as a garment. Despite the developments and advancements in opening devices, of the type set forth above, there is still a need for an improved opening device which can be combined with a garment that provides an easy way to remove a cap from the container. More specifically, a garment including an opening device mounted on a closure flap, which are concurrently positionable between open and closed positions and which will not derogatorily detract from the appearance of the garment or its comfort on an individual.

SUMMARY OF THE INVENTION

The present invention is directed to an opening device for removing a closure from a container. In more specific terms, the opening device may be mounted on and used in combination with a garment such as, but not limited to, a pair of shorts, such as "boardshorts" of the type well known and used in the sport of surfing and in similar or related environments.

Accordingly, a detailed description of the structural and operative features of the present invention will be set forth in greater detail hereinafter with reference to a boardshort type of garment. However, it is emphasized that the opening device of the present invention can be mounted on and operable in combination with a variety of different types of garments and/or components of a garment in addition to and other than boardshorts, bathing suits or the like.

Therefore, one or more preferred embodiments of the present invention includes the referred to garment, which may or may not include a pocket and/or pouch and a closure flap. As such, the closure flap will be selectively disposable between a covering and non-covering position relative to an access opening of the pocket or pouch. However, a "flap structure" or similar type component may be mounted on or included with the overall structure of the garment. In such an embodiment, the garment may be absent a pocket or pouch, but include the flap structure, in order to maintain or enhance the overall design and/or appearance of the garment. Accordingly, when the flap structure is used without the presence or inclusion of a pocket or pouch, it may be disposed, dimensioned, and configured to substantially represent or appear as a closure flap. Therefore, as used herein the term "closure flap" is used to represent a flap structure which may or may not be operatively associated with a pocket or pouch as further described herein.

In cooperation therewith, the opening device includes a base which is connected to the closure flap and movable therewith between the covering and non-covering positions. In at least one embodiment, the base is secured to an under surface or inner surface of the closure flap. As such, when the closure flap is in the covering position, the base is not exposed and not clearly viewable. Further, the disposition of the base on the closure flap is such that the base and an opening member connected thereto are disposable between operative and non-operative orientations. When the closure flap is in the covering position the base and opening member will be disposed in the non-operative orientation and not clearly viewable. However, when intended for use, the closure flap will be moved to the non-covering position, relative to the access to the pocket. Accordingly, when the closure flap is in the non-covering position, the base and the opening member will be "exposed" and therefore be clearly viewable and accessible. Therefore, the base and the opening member will be in the aforementioned operative orientation.

In addition to the above, one or more preferred embodiments of the opening device include the opening member having an apertured construction. The apertured construction comprises at least one aperture which is cooperatively dimensioned and configured to at least partially receive the closure of the container therein. In addition, at least a portion of the closure member is preferably formed from a rigid, semi-rigid or at least partially rigid material to the extent that a force, sufficient to remove the closure, will be exerted on the closure of the container causing its removal. By way of example, the opening member or at least a portion thereof may be formed from a carbon fiber material which has sufficient rigidity and strength to exert the aforementioned removing force on the closure of the container.

Further by way of example, the dimension, configuration and disposition of the at least one aperture of the apertured construction, as well as the remaining parts of the opening member may be such as to remove a bottle cap from a bottle type container. However, the opening device and attendant opening member may be otherwise appropriately structured to accommodate the removal of other types of closures from other types of containers.

Yet additional structural and operative features of one or more embodiments of the opening device include the base having at least one opening disposed in aligned relation with the at least one aperture in the opening member. Accordingly, the aforementioned "apertured construction" can also be descriptive of both the at least one aperture in the opening member and the at least one opening in the base, being disposed in aligned relation with one another. As will also be described in greater detail hereinafter, utilization of the opening device to remove a bottle cap or other type closure from a corresponding container involves the closure being disposed at least partially within the one aperture of the opening member concurrently to being at least partially received within the aligned one opening of the base. When so disposed, the at least partial rigidity of the opening member and the manipulation of the container closure relative to the base (or vice versa) will result in a removing force being exerted on the closure or bottle cap.

Yet additional features of the opening device include a cover connected to the base in covering or closing relation to the one aperture of the opening member as well as the aligned one opening of the base. Also, the disposition of the cover is such as to at least partially engage and/or receive the closure of the container as it enters through the one aperture of the opening member and the one opening of the base. Such a disposition of the cover will at least partially limit the passage of the closure concurrently through the aperture and opening respectively of the opening member and base. As such, the closure or bottle cap will be prevented from passing completely through the closure flap to which the base is attached. Therefore, in at least one embodiment, the cover is disposed on the opposite side of the base relative to the opening member, while still being disposed in closing or covering relation to both the aperture and opening.

In order to facilitate mounting and/or attachment of the opening device to the garment in a manner, which will not derogatorily affect the appearance of the garment or its comfort on a wearer, the base and the cover are preferably formed of a flexible, relatively high strength material. Such material can include, but is not intended to be limited to, a canvas or other appropriate material of sufficient strength or flexibility. This of course is in contrast to the appropriate rigidity of the opening member, as set forth above.

Yet additional features of one or more embodiments of the combination opening device and garment include an attachment structure at least partially mounted on the base and a correspondingly disposed part of the garment. Moreover, the attachment structure can be operable to removably retain the closure flap in the covering position relative to the access opening of the pocket or pouch. However once intended for use, the attachment structure may be easily disconnected from the garment thereby facilitating the disposition of the closure flap into the non-covering position concurrently to the base and opening member being disposed in the exposed, operative orientation.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
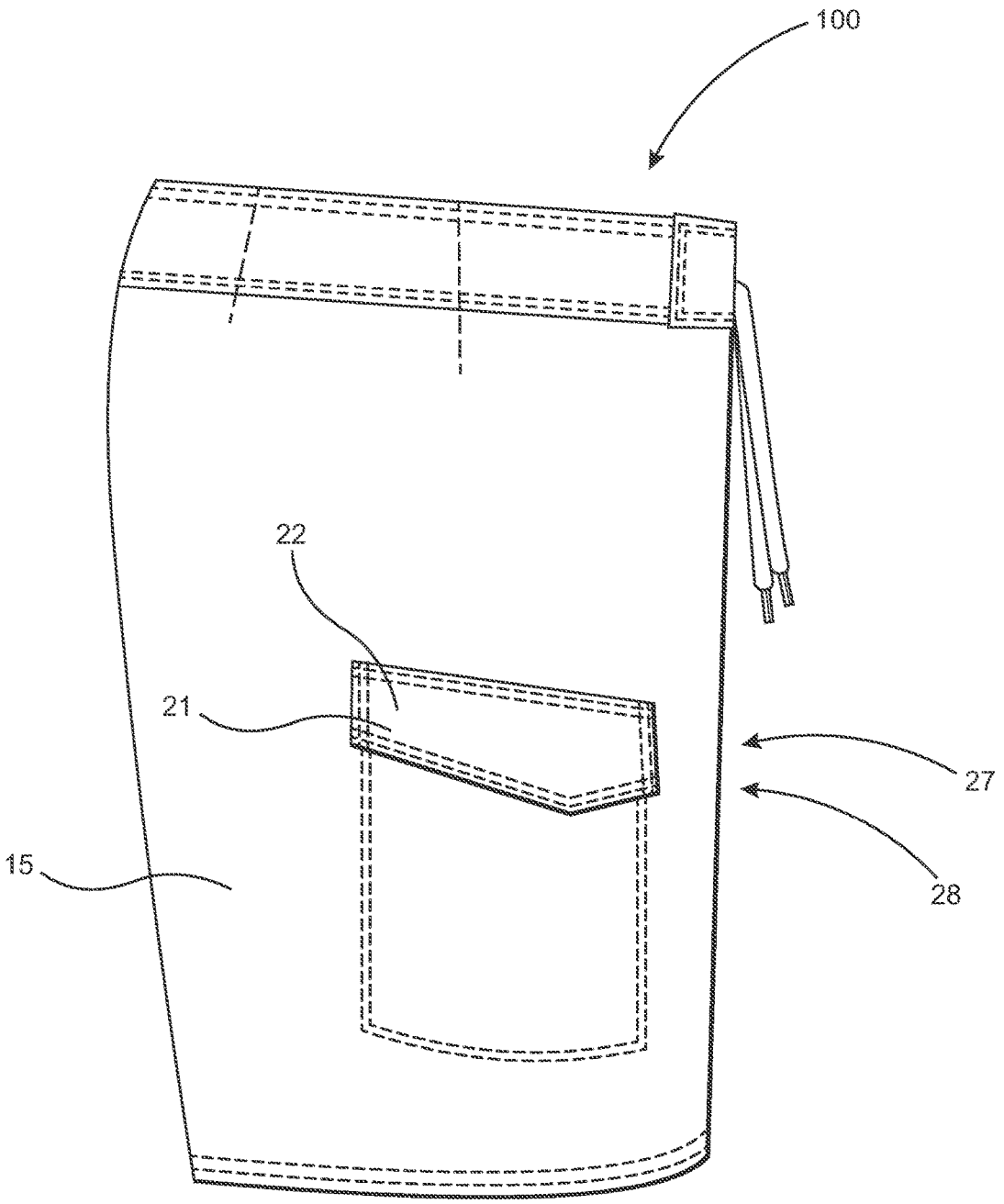
FIG. 1 is a side elevational view of a garment including an opening device mounted thereon.
Figure 2:
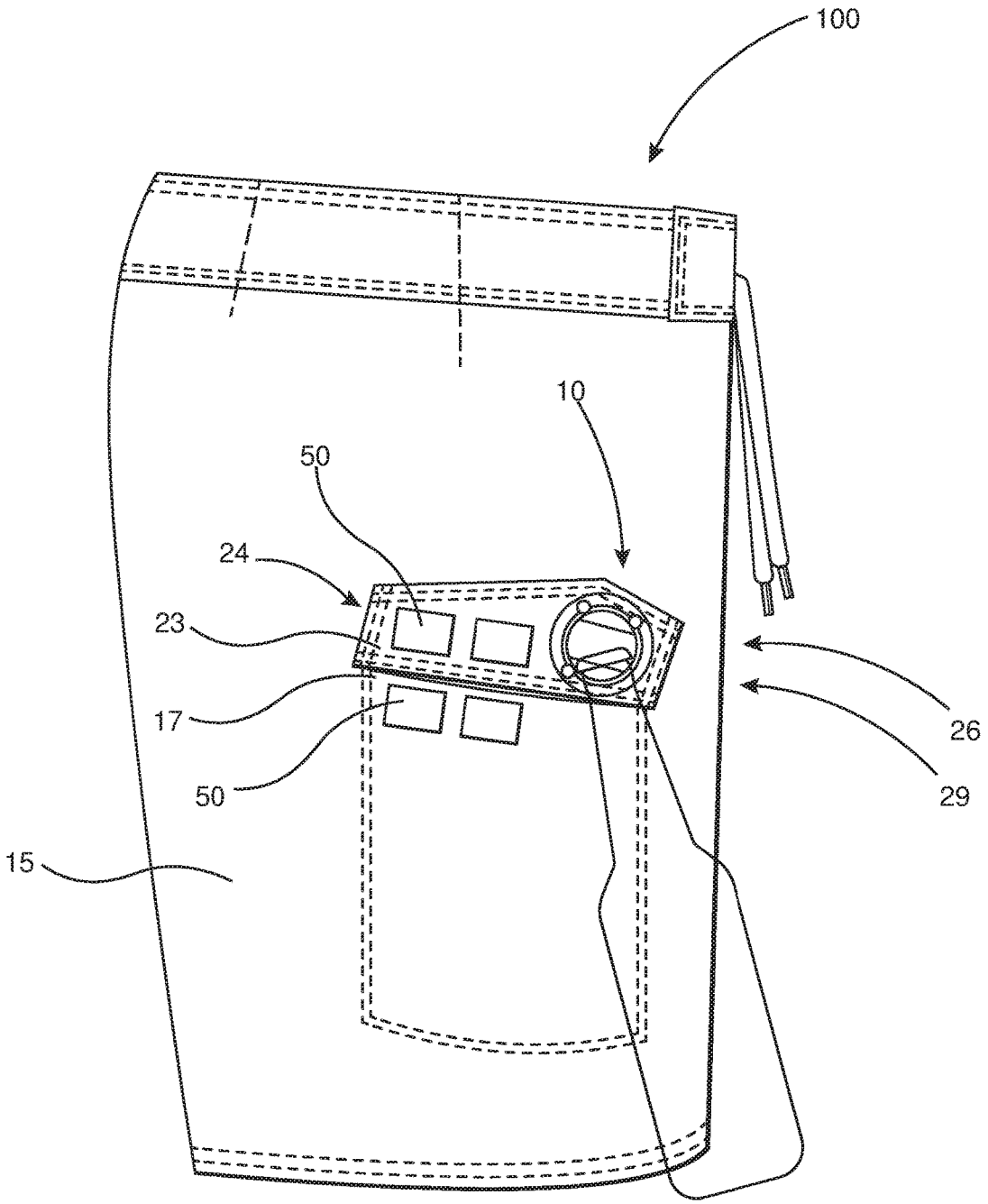
FIG. 2 is a side elevational view of the embodiment of FIG. 1, wherein the opening device is in an exposed, operative orientation.

As represented in the accompanying Figures and with initial reference to FIGS. 1 and 2, at least one preferred embodiment of the present invention is directed to an opening device generally indicated as 10. The opening device 10 includes sufficient structural and operative versatility to facilitate its use while mounted on and used in combination with a garment 100 such as, but not limited to, a pair of shorts, such as "boardshorts" or bathing suits. Accordingly, for purposes of clarity and without limiting the scope of the present invention, the structural features of this invention will be described with reference to the garment 100 being in the form of boardshorts, bathing suits, etc. of the type represented in FIGS. 1 and 2. However, it is emphasized that the opening device 10 of the present invention can be mounted on and operable in combination with a variety of different types of garments and/or components of a garment in addition to and other than boardshorts, bathing suits or the like.

As represented in FIGS. 1 and 2, one or more preferred embodiments of the present invention include the referred to garment 100, which may or may not include a pocket structure 15 including an access opening 17 structured to receive and store items of the user therein. As set forth in greater detail hereinafter, and as represented in FIG. 1, the garment 100 also includes at least one "flap structure". The flap structure is preferably disposed, dimensioned and configured in the form of a closure flap 22. As such, the closure flap 22 is selectively disposable between a covering position 27 (FIG. 1) and non-covering position 29 (FIG. 2) relative to the access opening 17 of the pocket structure 15.

However, in order to maintain and/or enhance the appearance of the garment 100, in the absence of a pocket or pouch on the garment 100, the "flap structure" may still be disposed, dimensioned and configured to represent a closure flap 22. Accordingly, when the garment 100 does not include a pocket or pouch, the closure flap 22 is still selectively positioned between the "covering position" 27 and the "non-covering position" 29.

Further, the "flap structure" may or may not be removably connected to the garment 100. This removable connection may be accomplished by an appropriate adhesive material or other sufficiently strong connecting structures to maintain the connection of the "flap structure" to the garment 100. Accordingly, such connecting structures may include one or more adhesive type connectors or similarly structured connectors such as VELCRO®, which allows a secure but removable positioning of the "flap structure" to the garment 100, but also allows for its removal from the garment when so chosen by the user. In contrast, such connecting structures may also include one or more static type connectors such as stitches or rivets which allow the fixed positioning of the "flap structure" to the garment 100.

In cooperation therewith, the opening device 10 includes a base 24 which is connected to the closure flap 22 and movable therewith between the covering position 27 and the non-covering position 29 relative to the access opening 17. In at least one embodiment, the base 24 is secured to an under surface or inner surface of the closure flap 22. As such, when the closure flap 22 is in the covering position 27, the base 24 is not exposed and not clearly viewable. In contrast, when the closure flap 22 is in the non-covering position 29, the base 24 is exposed, accessible and clearly viewable. Further, and as will be described in greater detail hereinafter, the disposition of the base 24 on the closure flap 22 is such that the base 24 is disposable between an operative orientation 26 and a non-operative orientation 28.

More specifically, when the closure flap 22 is in the covering position 27, the base 24 will be disposed in the non-operative orientation 28 and not clearly viewable, as represented in FIG. 1. However, when the opening device 10 is intended for use, the closure flap 22 will be moved to the non-covering position 29. Accordingly, when the closure flap 22 is in the non-covering position 29, the base 24 will be exposed and therefore be clearly viewable and accessible to the user. Therefore the base 24 and the opening member 30 connected thereto will be in the aforementioned operative orientation 26, as represented in FIG. 2.

As such, when the closure flap 22 is in the covering position 27, the base 24 is not exposed and not clearly viewable. Further, the disposition of the base 24 on the closure flap 22 is such that the base 24 and an opening member 30 connected thereto are disposable between an operative orientation 26 and a non-operative orientation 28. When an exterior or outer surface 21 of the closure flap 22 is viewable and the closure flap 22 is in the covering position, the base 24 and opening member 30 will be disposed in the non-operative orientation 28 and not be clearly viewable, as represented in FIG. 1. However, when the opening device 10 is intended for use, the base 24 will be moved to the operative orientation 26 and the closure flap 22 will be disposed in the non-covering position 29. Accordingly, the base 24 and the opening member 30 will be exposed and therefore be clearly viewable and accessible to the user. As such, the base 24 and the opening member 30 will be in the aforementioned operative orientation 26, as represented in FIG. 2.

Figure 3:
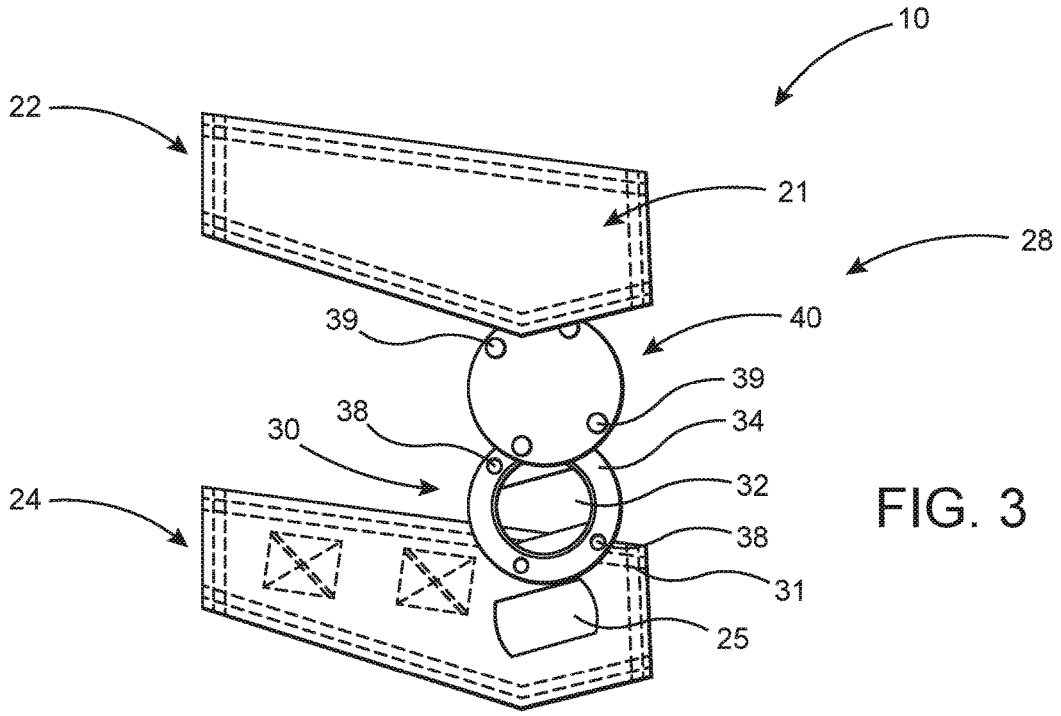
FIG. 3 is a detail view of structural and operative components of the present invention in an exploded form.

As is represented in FIGS. 1-5, the closure flap 22 may in fact be an integrated part of the base 24. However, it is emphasized that the closure flap 22 and the base 24 in fact may be different structures, wherein the closure flap 22 overlies the base 24 when the base 24 is in the non-operative orientation 28, as is represented in FIGS. 1 and 3.

As represented in FIG. 3, the opening device 10 includes the referred to opening member 30, structured and disposed to remove the closure from the container. As described above, the opening member 30 is connected to the base 24 and movable therewith between the operative orientation 26 and the non-operative orientation 28. One preferred embodiment of the opening device 10 includes the opening member 30 having an apertured construction 32. The apertured construction 32 comprises at least one aperture 34 which is cooperatively dimensioned and configured to at least partially receive the closure of the container therein.

In addition, at least a portion of the opening member 30 is preferably formed from at least a partially rigid material to the extent that a force, sufficient to remove the closure, will be exerted on the closure causing its removal. By way of example, the opening member 30, or at least a portion thereof, may be formed from a carbon fiber material which has sufficient rigidity and strength to exert the aforementioned removing force. Further, by way of example, the dimension, configuration, and disposition of the one aperture 34 may be such as to remove a bottle cap from a bottle type container. However, the opening device 10 and attendant opening member 30 may be otherwise appropriately structured to accommodate the removal of other types of closures from other types of containers.

Figure 4:
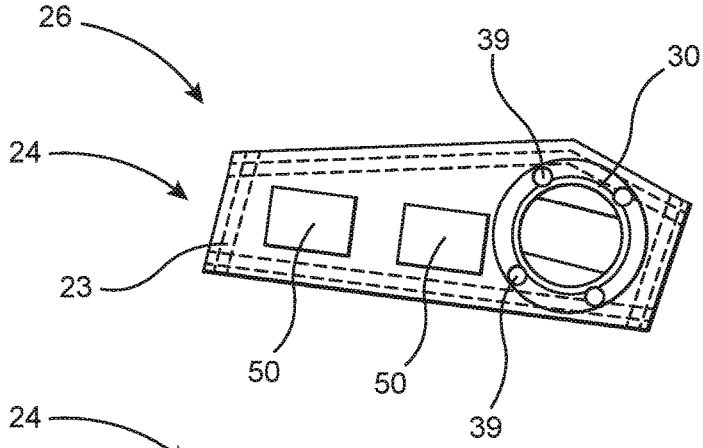
FIG. 4 is a detail view of the opening device including the structural and operative components thereof.
Figure 5:
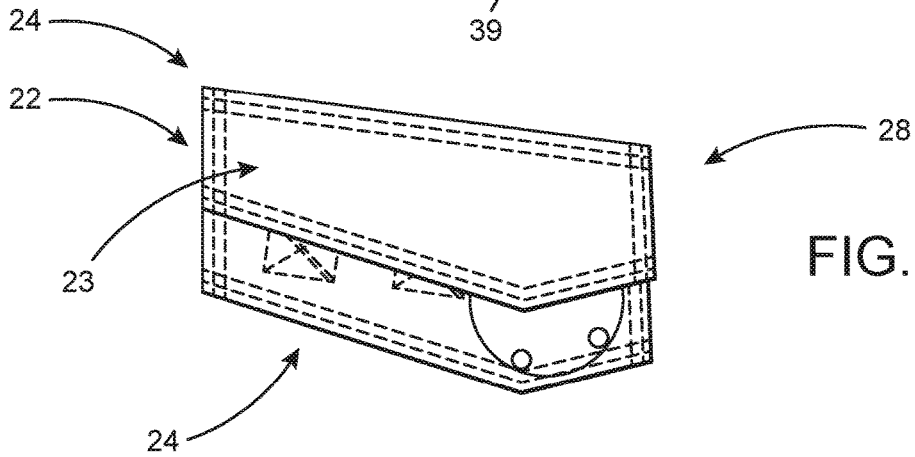
FIG. 5 is an at least partially exploded view of details of the opening device of FIGS. 1-4 and a closure flap of the garment, as represented in FIGS. 1 and two.

In addition, as represented in FIG. 3 the opening member 30 includes at least one orifice 38 disposed and structured to secure the opening member 30 to the base 24. More specifically, the disposition of the opening member 30 may be secured between the closure flap 22 and the base 24. However, in another embodiment, the opening member 30 is secured to the under surface 23 of the base 24, as represented in FIG. 4. As such, when the opening member 30 is disposed on the under surface 23 of the base 24, the opening member 30 is secured by at least one connector 39. Accordingly, the at least one connector 39 is disposed in secured aligned relation with the at least one orifice 38 of the opening member 30.

Additionally, when the closure flap 22 is in the covering position 27, the base 24 and the one aperture 34 of the opening member 30 are not exposed and not clearly viewable. Further, the disposition of the base 24 on the closure flap 22 is such that the base 24 and the one aperture 34 of the opening member 30 connected thereto are disposable between the operative 26 and non-operative orientation 28. More specifically, when the closure flap 22 is in the covering position 27, the base 24 and one aperture 34 of the opening member 30 will be disposed in the non-operative orientation 28 and not clearly viewable, as represented in FIG. 1. However, when the opening device 10 is intended for use, the closure flap 22 will be moved to the non-covering position 29 relative to an access opening 17. Accordingly, when the closure flap 22 is in the non-covering position 29, the base 24 and the one aperture 34 of the opening member 30 will be exposed and therefore be clearly viewable and accessible to the user. Therefore the base 24 and the one aperture 34 of the opening member 30 will be in the aforementioned operative orientation 26, as represented in FIG. 2. As such, the user can utilize the opening device 10 to remove the closure from the container.

Further, when the opening member 30 is secured between the base 24 and closure flap 22, as is represented in FIG. 3, the one aperture 34 of the opening member 30 will be clearly viewable when the base is in operative orientation 26. In contrast, when the opening member 30 is secured to the under surface 23 of the base 24, as is represented in FIG. 4, the entire opening member 30 will be clearly viewable. Accordingly, the at least one connector 39, disposed in aligned relation with the at least one orifice 38, will also be clearly viewable.

In another embodiment of the present invention, as represented in FIG. 3, when the opening member 30 is secured to the under surface 23 of the base 24, the opening member 30 includes at least one protruding lip 31. The protruding lip 31 is structured to exert a force on the closure while concurrently creating space between the closure and the garment 100. Utilization of the opening member 30 to remove the closure involves the closure being disposed at least partially within the one aperture 34 of the opening member 30. The space created allows for the closure to be removed without the closure engaging forcefully with the fabric of the garment 100. The protruding lip 31 extends outward from the opening member 30 a distance sufficient to create the aforementioned space in order to protect the garment 100 from the force exerted to remove the closure.

Yet additional structural and operative features of one or more embodiments of the opening device 10 includes the base 24 having at least one opening 25 disposed in aligned relation with the one aperture 34 of the opening member 30. Accordingly, the aforementioned apertured construction 32 can also be descriptive of both the one aperture 34 and the one opening 25, being disposed in aligned relation with one another. Further, as discussed above, the opening member 30 may be disposed between the closure flap 22 and base 24, or secured to the under surface 23 of the base 24. Utilization of the opening device 10 to remove a closure involves the closure being disposed at least partially within the one aperture 34 concurrently to being at least partially received within the aligned one opening 25. When so disposed, the at least partial rigidity of the opening member 30 and the manipulation of the closure relative to the base 24 (or vice versa) will result in a removing force being exerted on the closure or bottle cap.

Figure 6:
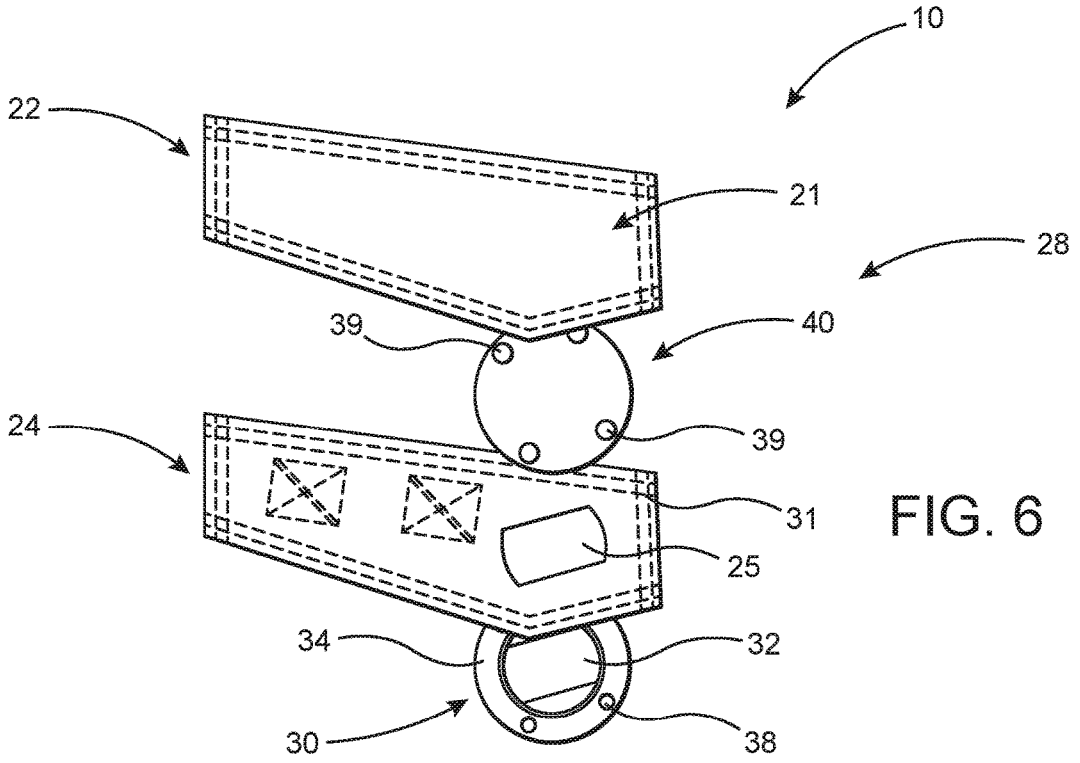
FIG. 6 is a is an at least partially exploded view of another embodiment with details of the opening device of FIGS. 1-4 and a closure flap of the garment, as represented in FIGS. 1 and 2.

As represented in FIG. 3, yet additional features of the opening device 10 include a cover member 40 connected to the base 24. The cover member is disposed in covering or closing relation to the opening member 30 as well as the aligned one opening 25 of the base 24. However, as discussed above, when the opening member 30 is disposed on the under surface 23 of the base 24, the cover member 40 is in covering or closing relation to only the one aperture 34 of the opening member 30. Additionally, the disposition of the cover member 40 is such as to at least partially engage and/or receive the closure as it enters through the one aperture 34 and the one opening 25. Such a disposition of the cover member 40 will at least partially limit the passage of the closure concurrently through the one aperture 34 and the one opening 25 respectively of the opening member 30 and base 24. As such, the closure or bottle cap will be prevented from passing completely through the closure flap 22 to which the base 24 is attached. By way of example, the cover member 40, or at least a portion thereof, may be formed from a material which has sufficient strength, such as canvas or the like. Further, in at least one embodiment, the cover member 40 is disposed on the opposite side of the base relative to the opening member 30, while still being disposed in closing or covering relation to both the one aperture 34 and the one opening 25. FIG. 6 is an illustrate example of another embodiment according to the present invention wherein a cover member 40 and an opening member 30 are disposed on opposite sides of the base 24.

In order to facilitate the mounting and/or attachment of the opening device 10 to the garment 100 in a manner which will not derogatorily affect the appearance of the garment 100 or its comfort on a user, the base 24 and the closure flap 22 are preferably formed of a flexible, relatively high strength material. Such material can include, but is not intended to be limited to, a canvas or other appropriate material of sufficient strength or flexibility. This of course is in contrast to the appropriate rigidity of at least a portion of the opening member 30, as set forth above.

However, while the placement of the opening device 10 on the outside of the garment 100 may be the most popular placement of use, the opening device 10 may also be placed on the inside of the garment 100 or connected via attachment to the garment 100. Additionally, when the closure flap 22 is selectively disposable between the covering position 27 and non-covering position 29 relative to the access opening 17, the pocket structure 15 of the garment 100 is not necessary to the invention, as discussed above. Further, there may be more than one opening device 10 on the garment 100, the opening device 10 may comprise different shapes, and be placed in different positions relative to the outside and/or inside of the garment 100.

As is represented in FIG. 4, yet another additional feature of the preferred embodiment of the opening device 10 includes an attachment structure 50. The attachment structure 50 is at least partially mounted on the under surface 23 of the base 24 and a correspondingly disposed part of the garment 100. Moreover, the attachment structure 50 can be operable to removably retain the base 24, in the non-operative orientation 28, to the garment 100. However, once intended for use, the attachment structure 50 may be easily disconnected from the garment 100 thereby facilitating the disposition of the base 24 into the operative orientation 26 concurrently to the base 24 and the opening member 30 being disposed in the exposed, operative orientation 26.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. A device structured for opening containers comprising:

a garment, a base movably connected to said garment and positionable thereon between an operative orientation and a non-operative orientation, an opening member connected to said base and movable with said base between said operative and non-operative orientations, said opening member having an apertured construction disposed and structured to remove a closure from the container, at least when said opening member is in said operative orientation, said operative and non-operative orientations respectively comprising an exposed and a covered disposition of said apertured construction, and a pocket structure defined in said garment and including an access opening; said base movable in covering and non-covering relation to said access opening of said pocket structure.

2. The device as recited in claim 1 wherein said apertured construction comprises at least one aperture dimensioned and configured to at least partially receive and engage the closure of the container therein.

3. The device as recited in claim 2 wherein said base includes at least one opening formed therein and disposed in aligned relation with said one aperture and in receiving relation to the closure of the container.

4. The device as recited in claim 3 further comprising a cover member connected to said base in covering relation to at least said one aperture and at least a portion of the closure of the container, when the closure of the container is received within said one aperture.

5. The device as recited in claim 3 further comprising a cover member connected to said base and concurrently disposed in covering relation to said one opening, said one aperture and the closure of the container, when the closure of the container is received within said one aperture.

6. The device as recited in claim 2 further comprising a cover member connected to said base in covering relation to said one aperture and in receiving relation to the closure of the container, when the closure of the container is received within said one aperture.

7. The device as recited in claim 6 wherein said cover member and said opening member are disposed on opposite sides of said base.

8. The device as recited in claim 7 wherein said base includes at least one opening formed therein and disposed in aligned relation with said one aperture and in covered relation by said cover member.

9. The device as recited in claim 1 wherein said opening member is formed of an at least partially rigid material.

10. The device as recited in claim 9 wherein said opening member is at least partially formed of carbon fiber material.

11. The device as recited in claim 9 wherein said base is formed of a flexible material.

12. The device as recited in claim 11 wherein said cover member is formed of a flexible material.

13. The device as recited in claim 9 wherein said cover member is formed of a flexible material.

14. The device as recited in claim 1 further comprising an attachment structure connected to said base and said garment and structured to removably connect and retain said base in said non-operative orientation.

15. The device as recited in claim 1 wherein said apertured construction comprises at least one aperture dimensioned and configured to at least partially receive and removably engage the cap of a bottle.

16. A garment at least partially structured to facilitate opening of a container, said garment comprising:

a closure flap movably connected to said garment and positionable thereon between an operative orientation and a non-operative orientation, an opening device structured for opening a container and including a base connected to said closure flap and movable therewith between said operative and non-operative orientations, said opening device including an opening member, said opening member connected to said base and movable with said base and said closure flap between said operative and non-operative orientations, said opening member disposed and structured to engage and exert a removing force on a closure of the container, said operative and non-operative orientations respectively comprising an exposed and a covered disposition of said opening member, and a pocket structure including an access opening; said closure flap movable in covering and non-covering relation to said access opening of said pocket structure.

17. The garment as recited in claim 16 wherein said operative orientation of said opening member substantially corresponds to said non-covering relation of said closure flap.

18. The garment as recited in claim 16 wherein said non-operative orientation of said opening member substantially corresponds to said covering relation of said closure flap.

19. The garment as recited in claim 16 wherein said base and said opening member are connected to an inner surface of said closure flap.

20. The garment as recited in claim 16 wherein said opening member comprises at least one aperture dimensioned and configured to at least partially receive and engage the closure of the container therein.

21. The garment as recited in claim 20 wherein said base includes at least one opening formed therein and disposed in aligned relation with said one aperture and in receiving relation to the closure of the container.

22. The garment as recited in claim 21 further comprising a cover member connected to said base and concurrently disposed in covering relation to said one opening, said one aperture, and the closure of the container, when the closure of the container is received within said one aperture.

23. The garment as recited in claim 22 wherein said cover member and said opening member are disposed on opposite sides of said base.

24. The garment as recited in claim 16 wherein said opening member comprises at least one aperture dimensioned and configured to at least partially receive and engage the closure of the container therein; a cover member connected to said base and disposed in covering relation to said one aperture and the closure of the container, when the closure of the container is received within said one aperture.

25. The device as recited in claim 24 wherein said cover member and said opening member are disposed on opposite sides of said base.

26. The garment as recited in claim 25 wherein said base includes at least one opening formed therein and disposed in aligned relation with said one aperture and in receiving relation to the closure of the container concurrently with said one aperture.

27. A device structured for opening containers, said device comprising:

a garment, a base movably connected to the garment and positionable thereon between an operative orientation and a non-operative orientation, an opening member connected to said base and movable therewith between said operative and non-operative orientations, a cover member connected to said base, said opening member having an aperture construction disposed and structured to remove a closure from the container, when said opening member is in said operative orientation, said cover member disposed in a covering relation to said opening member, said cover member and said opening member disposed on opposite sides of said base, said operative and non-operative orientations respectively comprising an exposed and a covered disposition of said aperture construction, and a pocket structure including an access opening; said base moveable in covering and non-covering relation to said access opening of said pocket structure.

* * * * *